US009163639B2

(12) United States Patent
Risser

(10) Patent No.: US 9,163,639 B2
(45) Date of Patent: Oct. 20, 2015

(54) AIR MIXING DEVICE FOR BUILDINGS

(75) Inventor: Philip E. Risser, Leola, PA (US)

(73) Assignee: VALCO COMPANIES, INC., New Holland, PA (US)

( * ) Notice: Subject to any disclaimer, the term of this patent is extended or adjusted under 35 U.S.C. 154(b) by 344 days.

(21) Appl. No.: 13/403,249

(22) Filed: Feb. 23, 2012

(65) Prior Publication Data

US 2013/0224043 A1 Aug. 29, 2013

(51) Int. Cl.

| | |
|---|---|
| ***F04D 25/06*** | (2006.01) |
| ***F04D 25/08*** | (2006.01) |
| ***F04D 17/10*** | (2006.01) |
| ***E04B 1/70*** | (2006.01) |
| ***E04B 2/02*** | (2006.01) |
| ***E04B 5/48*** | (2006.01) |

(Continued)

(52) U.S. Cl.

CPC ..... *F04D 25/08* (2013.01); *E04B 1/7076* (2013.01); *E04B 2/02* (2013.01); *E04B 5/48* (2013.01); *E04B 9/02* (2013.01); *E04F 13/007* (2013.01); *F04D 17/105* (2013.01); *F04D 25/088* (2013.01); *F04D 29/624* (2013.01); *F24F 7/007* (2013.01); *F24F 7/04* (2013.01); *F24F 13/04* (2013.01); *E04B 2002/0256* (2013.01)

(58) Field of Classification Search

CPC ..... F24F 7/013; F24F 7/065; F24F 7/007; F24F 7/04; F24F 13/04; F04D 25/08; F04D 25/088; F04D 17/105; F04D 29/624; E04B 1/7076; E04B 2/02; E04B 5/48; E04B 9/02; E04B 2002/0256; E04F 13/007

USPC ..... 454/228, 49, 229, 230, 234, 235, 237, 454/241, 248, 249, 251, 261, 269, 292, 299, 454/329, 341, 349, 354; 415/203, 206, 98, 415/101, 102; 416/185, 186, 186 R, 223 B, 416/231 B, 231 R; 417/53, 423.1

See application file for complete search history.

(56) References Cited

U.S. PATENT DOCUMENTS 4,222,318 A * 9/1980 Patton et al. ..... 454/209
4,849,862 A * 7/1989 Diskin et al. ..... 362/96

(Continued)

FOREIGN PATENT DOCUMENTS

EP 1204454 B1 * 3/2005 ..... B01D 46/26
JP 2006322619 11/2006

OTHER PUBLICATIONS

International Application No. PCT/US2013/026272: International Search Report dated Jun. 3, 2013, 3 pages.

*Primary Examiner* — Gregory Huson
*Assistant Examiner* — Dana Tighe
(74) *Attorney, Agent, or Firm* — Duane Morris LLP

(57) ABSTRACT

An air mixing unit suitable for buildings having open spaces. In one embodiment, the air mixing unit may include a centrifugal fan and mounting frame. The fan includes a rotatable body, a drive shaft defining a vertical rotational axis, a plurality of radial blades, a top air inlet, and a bottom air inlet. The fan is operable to draw air through the air inlet openings from axially opposing directions in some embodiments, mix the air, and discharge the mixed air laterally outwards from the fan to the open space. In some embodiments, the air mixing unit may be mounted near the ceiling of the building to temper cooler air drawn from outside with warmer inside room air before discharging the air into the space. A method for mixing and destratifying air within a building is also described.

19 Claims, 8 Drawing Sheets

(51) Int. Cl.

| | |
|---|---|
| ***E04B 9/02*** | (2006.01) |
| ***E04F 13/00*** | (2006.01) |
| ***F04D 29/62*** | (2006.01) |
| ***F24F 7/007*** | (2006.01) |
| ***F24F 7/04*** | (2006.01) |
| ***F24F 13/04*** | (2006.01) |

(56) References Cited

U.S. PATENT DOCUMENTS

| | | | | |
|---|---|---|---|---|
| 5,279,515 | A * | 1/1994 | Moore et al. | 415/119 |
| 5,645,483 | A | 7/1997 | Cushman | |
| 5,722,886 | A * | 3/1998 | Steckly | 454/229 |
| 5,967,764 | A * | 10/1999 | Booth et al. | 417/423.8 |
| 6,168,517 | B1 | 1/2001 | Cook | |
| 6,471,738 | B1 | 10/2002 | Thompson et al. | |
| 6,511,286 | B2 * | 1/2003 | Miyamoto | 415/191 |
| 7,381,129 | B2 | 6/2008 | Avedon | |
| 2005/0260073 | A1 * | 11/2005 | Hsu et al. | 415/199.6 |
| 2009/0123284 | A1 | 5/2009 | Madsen | |
| 2011/0111687 | A1 | 5/2011 | Massimino | |

* cited by examiner

AIR MIXING DEVICE FOR BUILDINGS

FIELD

The present invention generally relates to air mixing devices, and more particularly to an air mixing device suitable for use in open buildings spaces.

BACKGROUND

Air mixing devices such as fans are useful in larger open commercial and industrial building spaces for a variety of reasons. These air mixing devices may be used for recirculating air within the open space defined by the building superstructure (e.g. walls, floor, and ceiling) to provide proper ventilation and reduce vertical temperature stratification of air within the space. This destratifying effect helps maintain a uniform temperature within the structure for optimum comfort of the building occupants and heating/cooling efficiency by circulating warm air which rises and typically occupies the upper elevations with cooler air which sinks and typically occupies the lower elevations within the open space.

In addition to temperature regulation, air mixing devices also serve an additional useful purpose when the building structure serves as a commercial breeding and rearing facility for animals which occupy the space. In the case of a poultry house, for example, levels of ammonia generated by decaying manure may be higher near the floor than at higher elevations within the building structure. To promote healthy air quality within the confined environment and meet the ventilation requirements of the animals, it is further useful therefore to reduce air stratification within such spaces by creating an air circulation pattern which vertically mixes the air for purposes of maintaining uniform air quality throughout the facility.

To further promote good air quality, some air mixing devices may draw fresh replacement outside air into the building. During colder months, air mixing devices may sometimes incorporate heat exchanger elements (e.g. electric resistance, steam, or hot water coils) to heat the outside air prior to discharge into to the open building space. This air tempering approach alone, however, increases energy consumption and operating costs. In addition, the heated hot air may be discharged from the air mixing devices at significantly higher temperature than the room air inside the building and at high velocity which may cause uncomfortable drafts and temperature fluctuations at various locations within the facility.

An air mixing device and system is desired for improved air mixing, distribution, and energy efficiency.

SUMMARY

An air mixing device or unit is provided that is operable to mix and temper fresh outside air with warmer room air prior to discharging the mixed air to open spaces within a building. The air mixing unit further creates an air circulation pattern that is intended to destratify air within the space to promote uniform temperatures and air quality. The buildings may be any type of building structure such as commercial and industrial facilities having human and/or animal occupants, including animal rearing structures such as without limitation poultry houses. The air mixing unit is readily adaptable to private and public spaces such as without limitation warehouses, factories, auditoriums, and other venues having relatively larger open spaces that require ventilation and heating.

In one embodiment according to the present disclosure, an air mixing unit for a building includes a frame configured for mounted to a building superstructure and a centrifugal fan supported by the frame for rotational movement. The fan includes a rotatable body, a drive shaft defining a vertical rotational axis, a plurality of radial blades extending in a horizontal direction outwards from the fan axis, a top air inlet, and a bottom air inlet. The air mixing unit further includes a motor drive operable to rotate to the fan. Rotation of the fan draws inlet air through both the top and bottom air inlets, mixes the inlet air together, and radially discharges the mixed air laterally outwards from the fan. In some embodiments, the top and bottom air inlets are axially aligned with the vertical rotational axis of the fan to draw air into the fan from opposing axial directions. In further embodiments, the top air inlet may be defined by at least one opening in a circular shaped upper plate and the bottom air inlet may be defined by at least one opening in a circular shaped lower plate spaced vertically apart from the upper plate.

In one embodiment according to the present disclosure, an air mixing system includes a building having a floor, a ceiling, and vertical walls defining an open space, and an air mixing unit disposed in the open space of the building. The air mixing unit includes a rotatable centrifugal fan having horizontally-oriented radial vanes, axially aligned top and bottom air inlets, a vertically-oriented fan drive shaft operable to rotate the fan and defining a vertical rotational axis of the fan, and a lateral discharge outlet. The system further includes a motor drive operable to rotate to the fan. Rotation of the fan draws an air inlet stream into the fan from opposing axial directions through the bottom and top air inlets, mixes the air inlet streams for tempering the air, and radially discharges the mixed air laterally outwards from the fan to the open space. In some embodiments, the discharge outlet extends for 360 degrees around the rotational axis of the fan. In further embodiments, the fan may be mounted proximate to the ceiling of the building.

In one embodiment according to the present disclosure, a method for mixing and destratifying air within an open space of a building is provided. The method includes: mounting a centrifugal fan in the open space, the fan including a rotatable fan body comprised of vertically spaced apart upper and lower plates each having at least one air inlet opening formed therein, and a plurality of radial blades mounted between the plates, the fan further including a vertically oriented central drive shaft operable to rotate the fan and defining a rotational axis of the fan; rotating the drive shaft with a motor drive; drawing inlet air streams into the fan from opposing axial directions through the air inlet openings in the upper and lower plates; mixing the inlet air streams; and radially discharging the mixed inlet air streams laterally outwards into the open space. In some embodiments, the air inlet openings are concentrically aligned with the rotational axis of the fan. In some embodiments, the fan includes a lateral air discharge outlet that extends for a full 360 degrees around the fan.

BRIEF DESCRIPTION OF THE DRAWINGS

The features of the preferred embodiments will be described with reference to the following drawings where like elements are labeled similarly, and in which.

Figure 1:
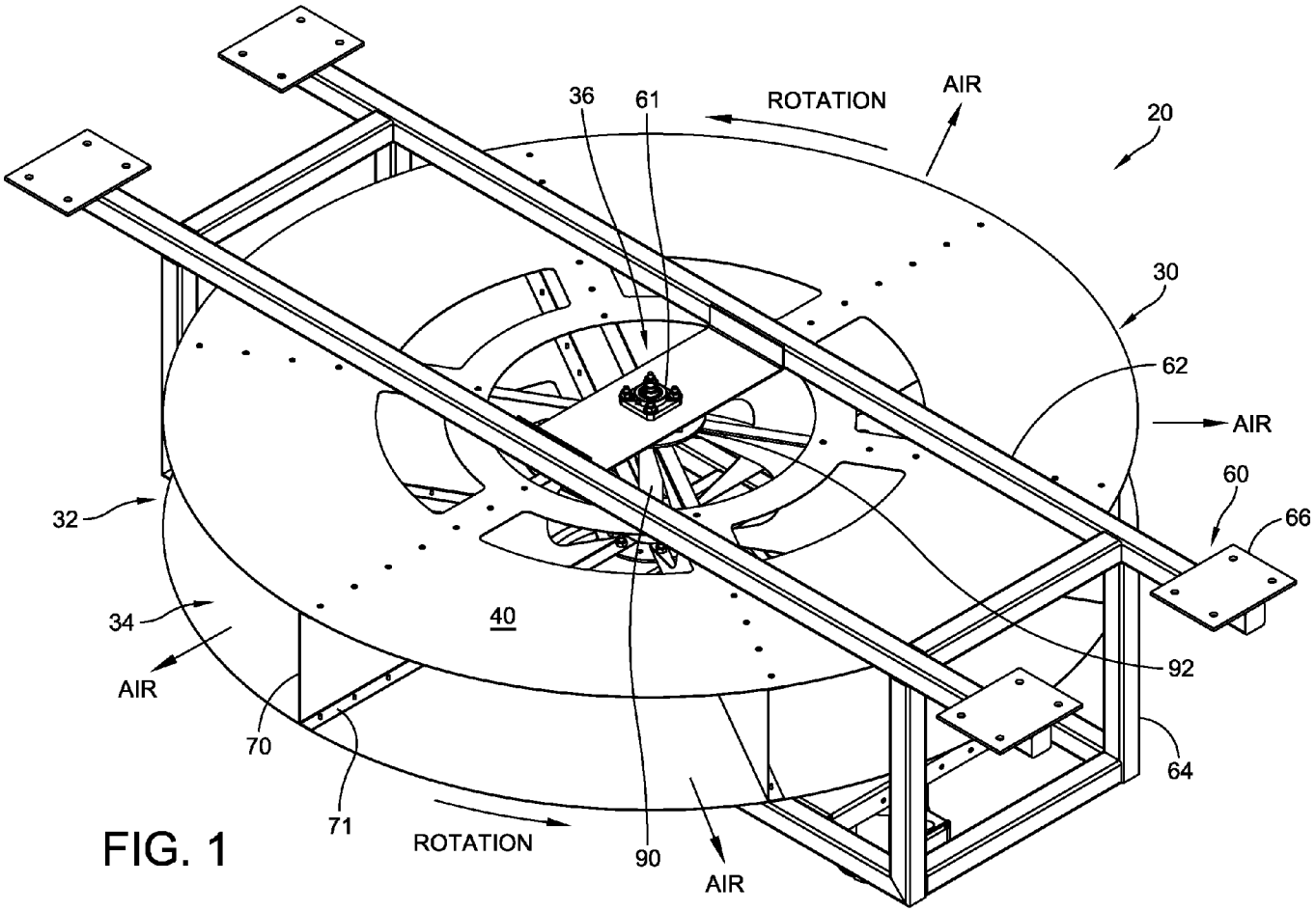
FIG. 1 is a top perspective view of one embodiment of an air mixing unit according to the present disclosure including a centrifugal fan, mounting frame, and motor drive.

All drawings are schematic and are not drawn to scale.

DETAILED DESCRIPTION

This description of illustrative embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. The term "adjacent" as used herein to describe the relationship between structures/components includes both direct contact between the respective structures/components referenced and the presence of other intervening structures/components between respective structures/components. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIGS. 1-4 shows an air mixing device or unit 20 according to the present disclosure suitable for application and mounting in a building structure defining an open space. Air mixing unit 20 generally includes a centrifugal fan 30, motor drive 100, and mounting frame 60 as further described herein.

Fan 30 may be a dual air inlet device in some embodiments configured to draw air from two different axial directions, as shown in FIGS. 1-4. Fan 30 includes a body 32 having a circular upper plate 40, a circular lower plate 50 spaced apart from the upper plate, and radial blades 70. The vertically and circumferentially extending open lateral annular sides of fan 30 formed by the spaced apart upper and lower plates 40, 50 define an annular shaped lateral air discharge outlet 34 from fan 30 through which air is radially and laterally discharged upon rotation of the fan. In one embodiment, the open annular sides of fan 30 extend completely around the fan in circumferential extent wherein air is discharged radially for an angular range of a full 360 degrees.

Fan 30 includes two axial and opposing air inlets including an upper/top air inlet 36 and lower/bottom air inlet 38 through which air is drawn into the fan. Top air inlet 36 is defined by upper plate 40 which includes a centrally located main air inlet opening 42 and a plurality of auxiliary air inlet openings 44 spaced around opening 42; air inlet openings 42 and 44 collectively defining a first air inlet such as upper air inlet 36. Main air inlet opening 42 may be circular shaped as shown and arranged concentrically with respect to a rotatable central fan drive shaft defining a vertical rotational axis RA for fan 30. Auxiliary air inlet openings 44 may be arcuately shaped in some embodiments and arranged circumferentially spaced apart proximate to main air inlet opening and concentrically aligned with rotational axis of the fan. The auxiliary air inlet openings 44 increase the air intake flow into the fan and are also provided for structural reasons such as avoiding a single very large central air inlet opening which may weaken the fan structure.

Configured similarly to upper plate 40 in some embodiments, bottom air inlet 36 is defined by lower plate 50 which may include a centrally located main air inlet opening 52 and a plurality of auxiliary air inlet openings 54 spaced around opening 52; air inlet openings 52 and 54 collectively defining a second air inlet such as lower air inlet 38. In other embodiments, the air inlets in the upper and lower plates 40, 50 may be configured differently and/or vary in size to alter the square inches of open area thereby being useful for increasing or decreasing the quantity of air drawn into fan 30 through either the upper or lower air inlets 36, 38. This allows one skilled in the art to regulate the amount of already warmed room air that is mixed in fan 30 with cooler outside air to balance the air tempering. It will be appreciated, therefore, that the size and/or configuration of the air inlet openings may be varied and do not limit the invention.

A plurality of radial blades 70 are provided and arranged around rotational axis RA of the fan and rotatable central drive shaft 80. Blades 70 extend radially and laterally outwards from rotational axis RA and are circumferentially spaced apart by an angular distance as shown in FIGS. 1-4. Blades 70 may be spaced evenly apart circumferentially as shown, or alternatively may have uneven spacing. In some embodiments, preferably at least four blades 70, but more preferably at least six blades may be provided. In some possible embodiments, blades 70 may be configured as radially straight blades (shown), backward-curved or inclined blades (curving radially in the direction of the fan's rotation, or forward-curved or inclined blades (curving radially in a direction away or against the fan's rotation). These type fan blade configuration are well known to those skilled in the art without further elaboration.

With continuing reference to FIGS. 1-4, blades 70 are rigidly and fixedly attached between upper and lower plates 40, 50 of fan body 32. In some embodiments, blades 70 may be mounted to both the upper and lower plates 40, 50 as shown for adding rigidity to the fan body assembly collectively defined as including the plates and blades. Blades 70 may be attached to upper and lower plates 40, 50 by any suitable mechanical means including fasteners (as shown), welding, or other means used in the art. In some embodiments, the blades 70 may be attached to upper and lower plates 40, 50 along a majority of the radial length of the blades. Blades 70 may include upper and lower flanges 71, 73 disposed perpendicular to the main body of the blades as shown to facilitate mounting. As shown in FIGS. 1-4, the blades 70 in this embodiment are mounted to upper and lower plates 40, 50 between the arcuate auxiliary air inlet openings 44, 54 on the solid portion of the plates disposed circumferentially between the auxiliary openings (see radial fastener patterns).

With continuing reference to FIGS. 1-4, blades 70 include an outer plain end 72 and an inner mounting end 74 for rigid attachment to two circular flanges 92 disposed on each of the opposite ends of a tubular hub 90. In some embodiments, tubular hub 90 may be a section of pipe. Mounting end 74 of blade 70 may be attached to circular flanges 92 by any suitable mechanical means including fasteners (as shown), welding, or other means used in the art. FIG. 5 is a detailed view of the lower connection between tubular hub flange 92 and mounting end 74 of blades 70 taken from FIG. 3 wherein threaded fasteners 77 are used to attach the blades to the flange via a plurality of concentrically aligned holes provided in the flange and blades (see also FIG. 8). In this embodiment, threaded fasteners 77 such as, without limitation, bolts with nuts may be used.

Figure 8:
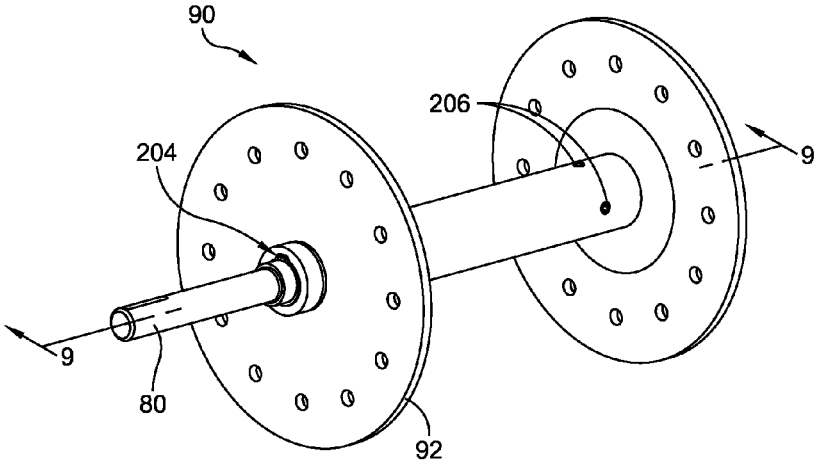
FIG. 8 is a perspective view of the flanged tubular fan blade hub of FIGS. 1-5.
Figure 9:
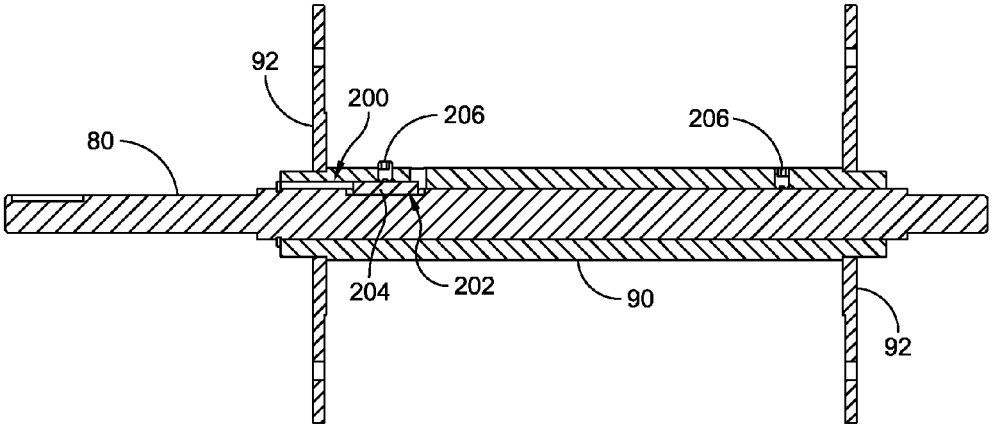
FIG. 9 is a cross-section view thereof taken along line 9-9 in FIG. 8.

Drive shaft 80 is configured and dimensioned to be insertably received through tubular hub 90 as shown in FIGS. 1-4. Drive shaft 80 and tubular hub 90 are mechanically coupled together so that rotation of the shaft concomitantly rotates the hub with fan blades 70 attached thereto, as further described herein. Any suitable method commonly used in the art may be used to couple these components together, including without limitation shaft key-keyway systems, mechanical fasteners, welding, and others. In one embodiment, as shown in FIGS. 5, 8, and 9, a key-keyway system may be used wherein drive shaft 80 and tubular hub 90 each have an axially extending rectangular keyway 200, 202 formed therein (shown by dashed lines in FIG. 5) that is engaged by a longitudinally inserted and complementary configured key 204 with square cross section. After positioning in the keyways, the key 204 may be held in place by setscrew 206. A viewing aperture 208 may be provided in some embodiments as shown in FIG. 5 to confirm proper insertion and positioning of the key 204 within the keyways 200, 202 prior to tightening the setscrew 206. As shown in FIGS. 8 and 9, one or more additional setscrews 206 may be provided at the opposing end of pipe hub 90 to assist with securing the shaft 80 to the pipe hub. Other suitable key-keyway or other types of mechanical couplings may be used.

A mixing chamber 31 (see FIGS. 6 and 7) is defined proximate to and around tubular hub 90 at the center of fan blades 70 for mixing the air together from top and bottom air inlets 36, 38 of the fan 30 prior to discharge from the fan. In some embodiments, blades 70 may include a concave shaped cutout 76 disposed near mounting end 74 as shown in FIGS. 1-4. The inner mounting end 74 having an edge 75 extending between the upper and lower flanges 71, 73 of the blade 70, wherein the edge curves away from the tubular hub between the two circular flanges 92 disposed on each of the opposite ends of the tubular hub. The cutouts 76 provide space for air mixing and define the air mixing chamber 31, while allowing the blades 70 to be connected to flanges 92.

Figure 4:
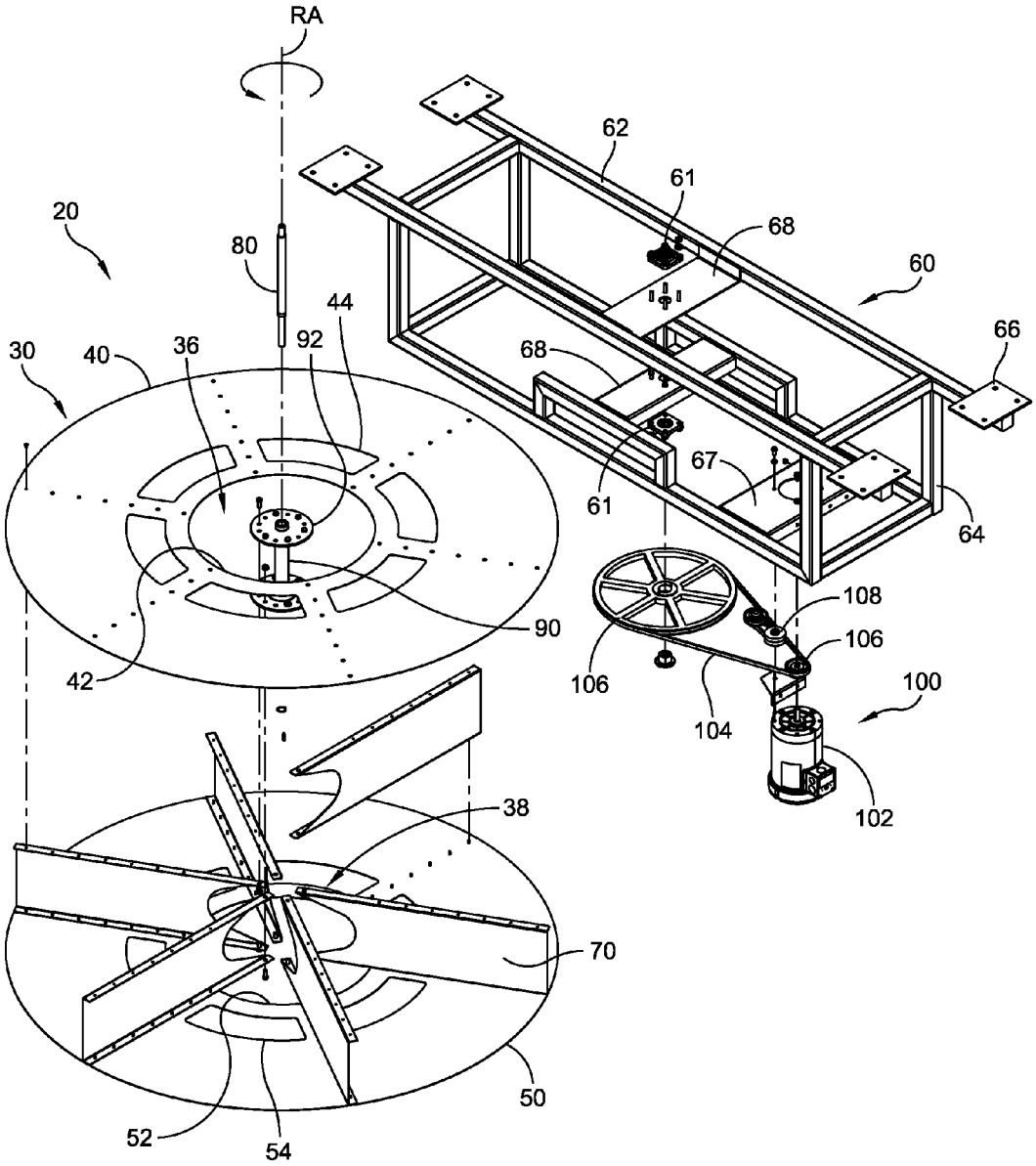
FIG. 4 is an exploded perspective view thereof.
Figure 5:
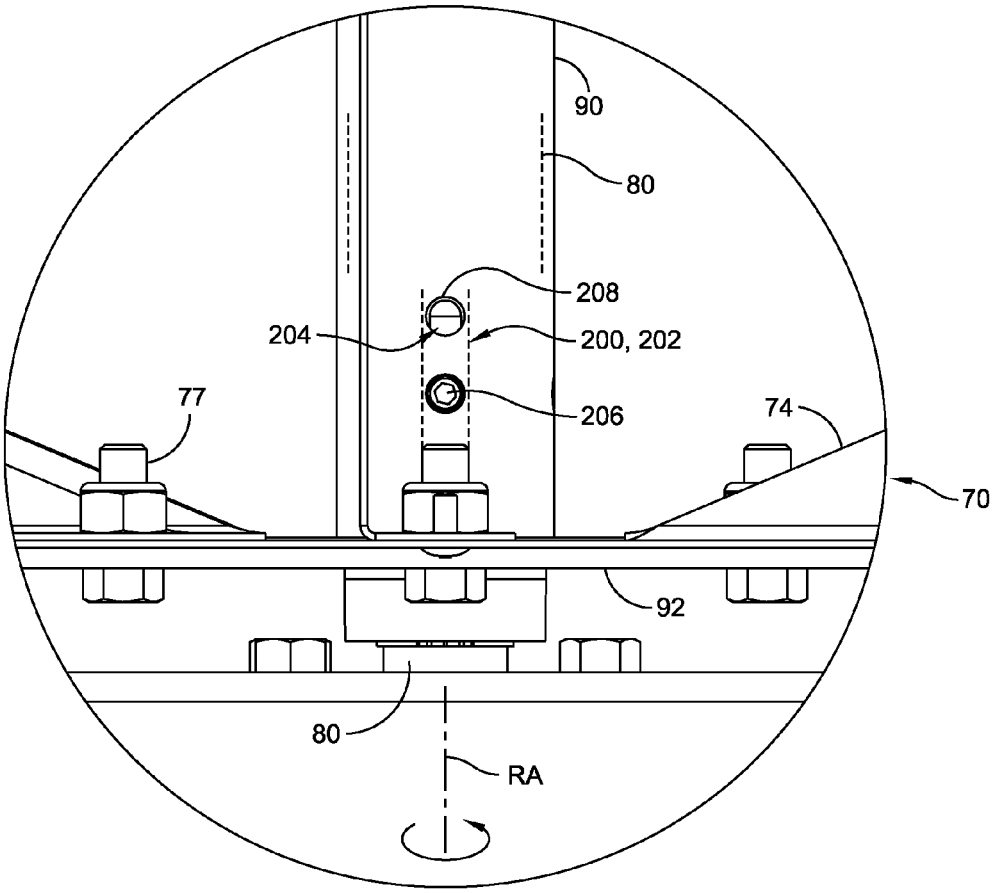
FIG. 5 is a detailed view of a fan mounting portion of the air mixing unit taken from FIG. 3.

Referring to FIGS. 1-4, the fan 30 is rotatably supported by a mounting frame 60 including horizontal and vertical members 62, 64 which may be interconnected and arranged in the configuration of an open box frame having open sides and ends, as best shown in the exploded view of FIG. 4. In some embodiments, the frame 60 may be larger in length than in width as shown; the length defining a longitudinal frame axis. Members 62, 64 may be tubular shaped in some embodiments including round or square tubes. The mounting frame 60 is configured and dimensioned to receive fan 30 therein. Frame 60 may further include mounting plates 66 which are arranged and configured to uniformly support the fan 20 from the building superstructure such as the ceiling, walls, etc. Mounting plates 66 may be secured to the building superstructure by welding, fasteners, or other suitable mechanical attachment means used in the art.

It will be appreciated that mounting frame 60 may have other suitable configurations so long as the fan 30 may be supported by the frame and in turn the building superstructure.

With continuing reference to FIG. 1-4, frame 60 further includes cross-support plates 68 onto which fan 30 is mounted and supported for rotational movement. Cross-support plates 68 are oriented horizontally and may be laterally connected to longitudinally extending members 62 of frame 60. An upper and lower cross-support plate 68 may be provided for supporting both ends of drive shaft 80 of fan 20. One bearing flange 61 is provided and mounted on each of the upper and lower cross-support plates 68. The bearing flanges 61 are each engaged by one end of drive shaft 80 and are configured to support the drive shaft for rotational movement. Bearing flanges 61 may be mounted to the cross-support plates 68 by fasteners (shown), welding, or other suitable mechanical attachment means used in the art. Bearing flanges are commercially available such as Y-bearing flange units from SKF of Goteborg, Sweden and other manufacturers.

Figure 2:
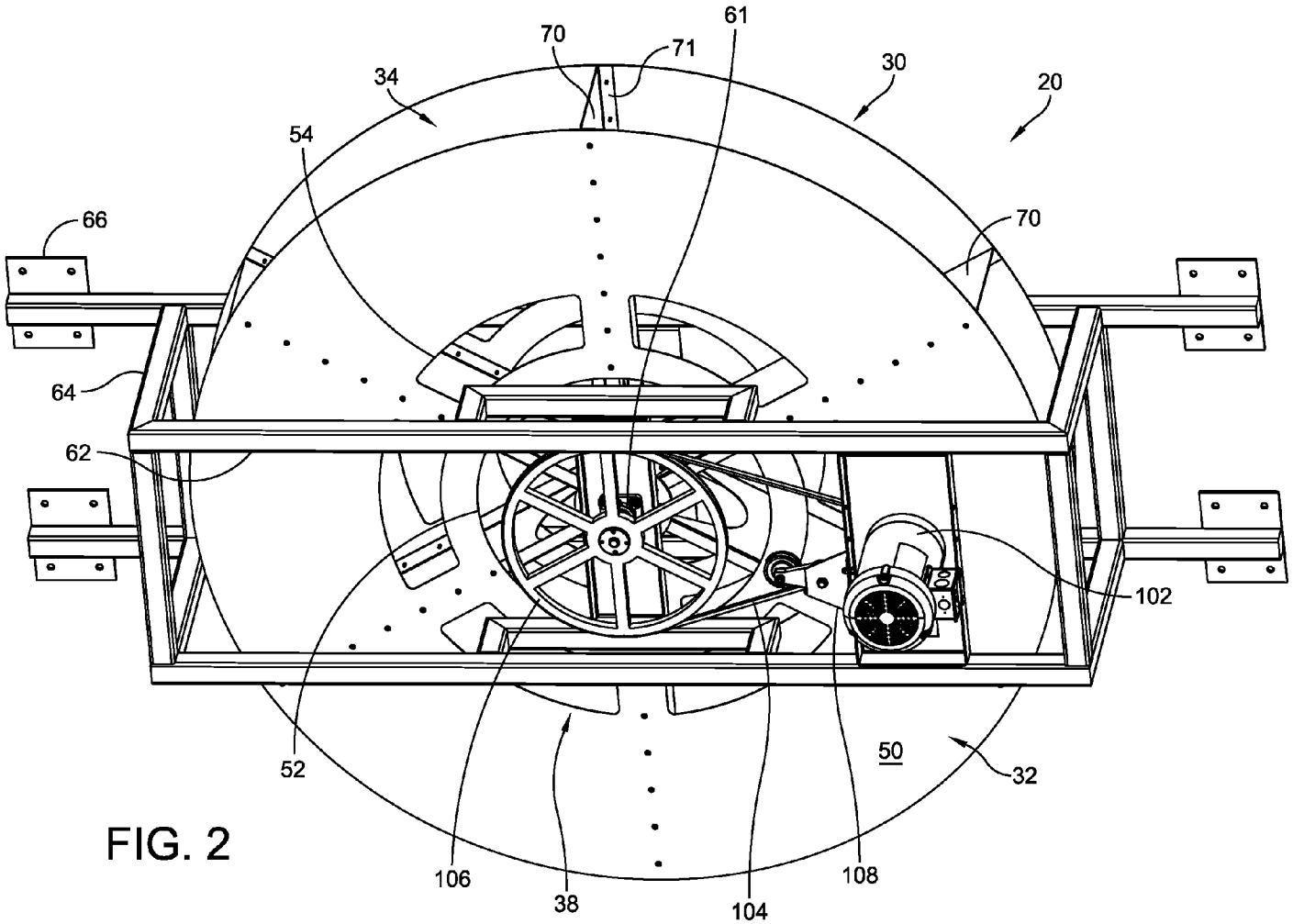
FIG. 2 is a bottom perspective view thereof.
Figure 3:
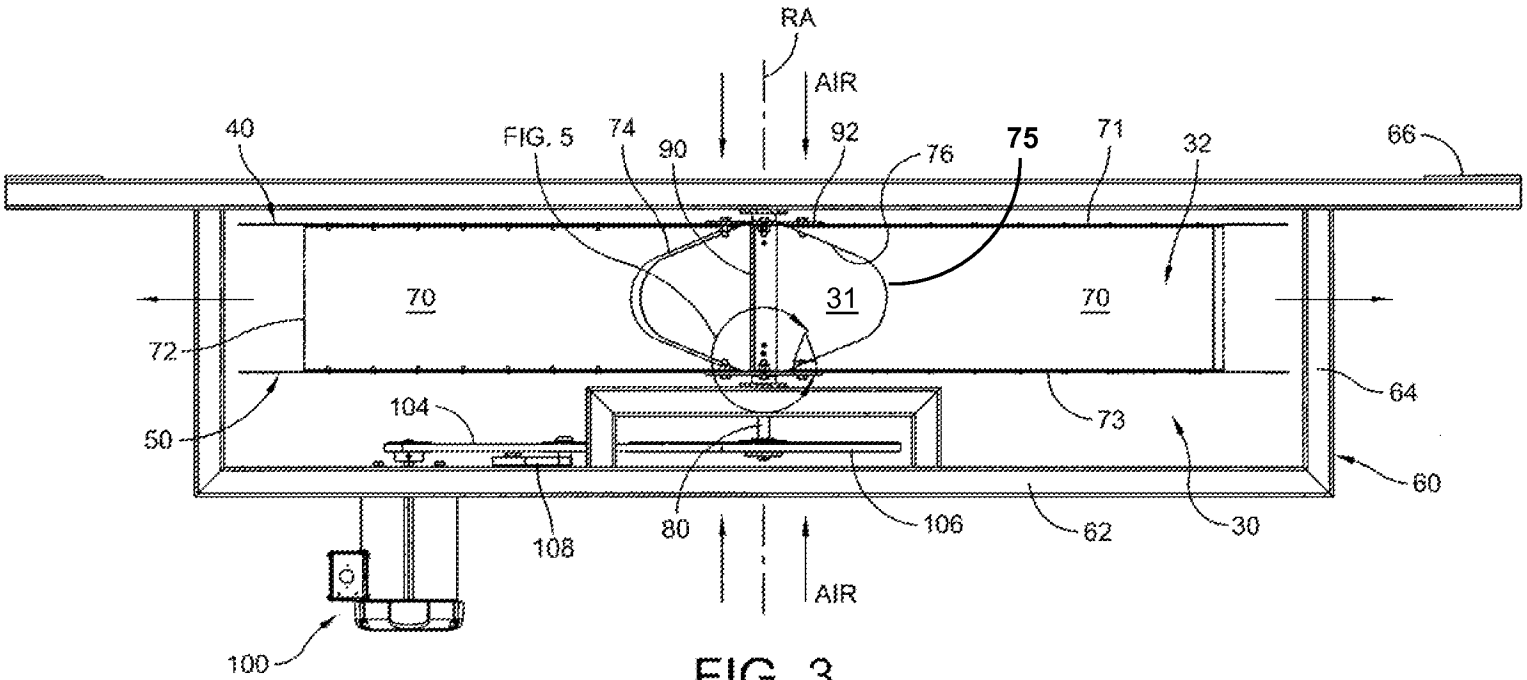
FIG. 3 is a side elevation view thereof.

In some embodiments, fan 30 (i.e. upper and lower plates 40, 50) may protrude laterally outwards beyond frame 60 as shown in FIGS. 1 and 2. Frame 60 may therefore be considered to form an open frame fan design.

Referring to FIGS. 1-4, fan 20 further includes a motor drive 100 which is operable to rotate fan 30. Fan 30 may be rotated in either rotational direction by the motor drive. In one embodiment, motor drive 100 includes an electric motor 102 which may be supported by mounting frame 60 as shown. A cross-support plate 67 may be separately provided for mounting motor 102. Motor 102 may be directly or indirectly coupled to fan drive shaft 80. In the embodiment shown, motor drive 100 may be a belt-drive type system including belt 104, a pair of sheaves 106, and an auto-tensioning unit 108 to maintain belt tension. One sheave 106 is a fan sheave configured for mounting to drive shaft 80 and may be larger than the other remaining motor sheave 106 configured for mounting on the motor output shaft as shown. Drive shaft 80 may be mechanically coupled to the larger fan sheave 106 by any suitable means such as, without limitation, interference or shrink fitting, keying, fasteners (e.g. set screws), etc. Drive shaft 80 extends through bearing flange 61 and the lower end of the shaft is rigidly coupled to the larger sheave 106 (best shown in FIGS. 2 and 3). Drive shaft 80 is rotated by the larger sheave 106 upon operation of the motor 102, which in turn rotates fan 30 to draw in air and discharge air radially. Other usual appurtenances for belt drive systems may be provided.

In other possible embodiments, motor drive 100 may be a direct drive system (not shown) wherein the motor 102 is directly coupled to fan drive shaft 80. In addition, a variable speed motor may be provided for either belt or direct drive options to vary the air delivery from fan 30. The invention is therefore not limited to any particular type drive system or motor so long as the motor is operable to rotate the drive shaft 80 and fan 30 coupled thereto.

Fan 30 may be formed of any suitably strong material having an appropriate thickness for the intended application. In some possible embodiments, upper and lower plates 40, 50 and fan blades 70 may be made of metal, reinforced or unreinforced plastics, fiberglass, graphite composite materials, or others. In some preferred embodiments, the plates and fan blades may be made of aluminum or galvanized steel of sufficient gauge so that fan 30 is structurally self-supporting. In one embodiment, 16 gauge galvanized steel plate may be used for the plates 40, 50 and blades 70.

Mounting frame 60 may be formed of any suitably strong material having an appropriate thickness for the intended application to support the weight of fan 30, motor drive 100, and related appurtenances. In some possible embodiments, the frame may be constructed of metal, reinforced or unreinforced plastics, fiberglass, graphite composite materials, or others. In some preferred embodiments, the frame 60 may be made of square tubes comprised of aluminum or galvanized steel of sufficient gauge. In one embodiment, 11 gauge square galvanized steel tubes may be used for horizontal and vertical members 62, 64.

Fan 30 may be of any suitable size for the intended application. In one representative embodiment for purposes of illustration only, without limitation, fan 30 may have a diameter of about 72 inches (i.e. diameter of circular upper and lower plates 40, 50) and height of approximately 10 inches (i.e. approximately height of radial blades 70). Any suitably sized fan 30 may be provided depending on the volumetric air flow capacity (e.g. CFM) needed for the intended application. It will be appreciated that in addition to the physical size of fan 30 provided, the speed of the motor drive 100, number of blades 70 and their configuration, and other factors will determine the air flow capacity of the fan 30. It is well within the ambit of one skilled in the art to modify these parameters as needed for a given fan installation. As a non-limiting example, for the exemplary dimensioned embodiment given above, fan 30 may have a volumetric flow capacity of about 30,000 CFM.

Figure 6:
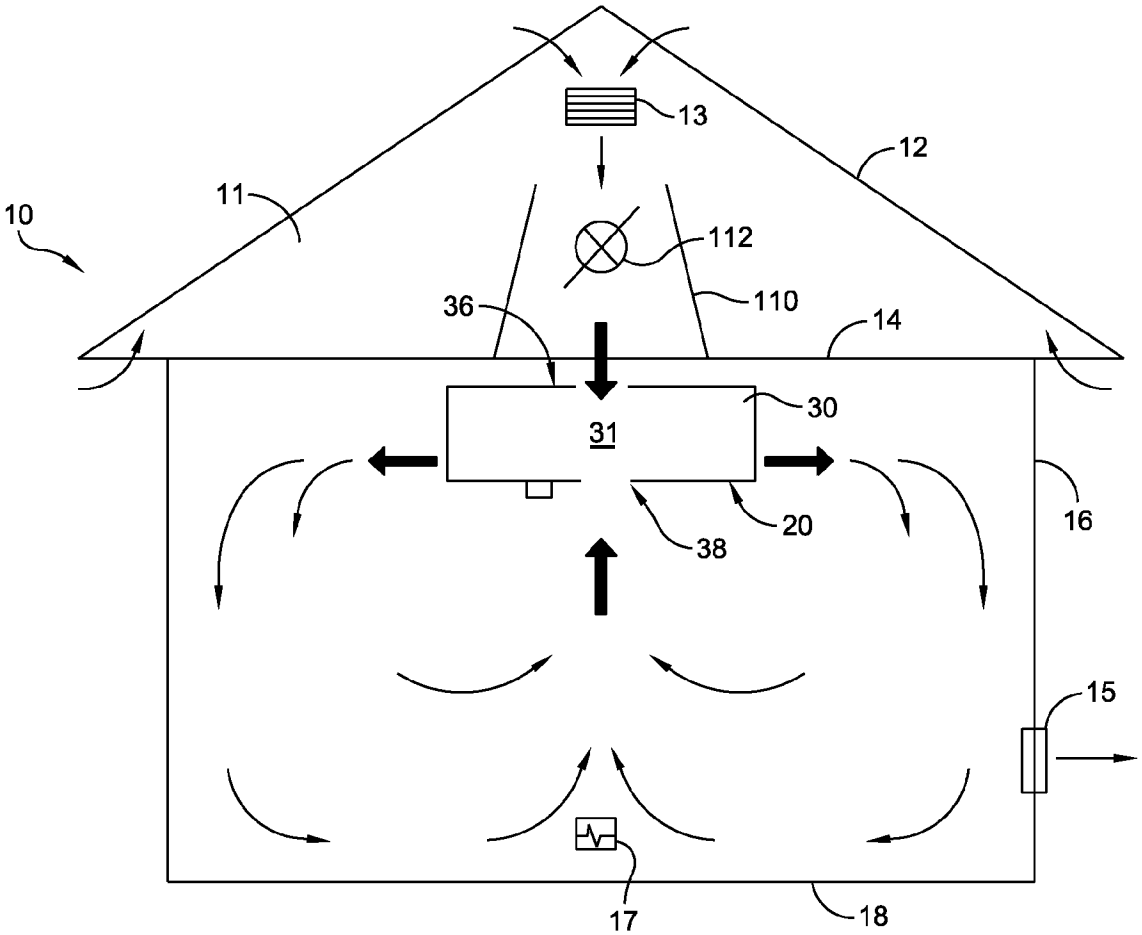
FIG. 6 is a cross-sectional end view through a building structure having an open space with the air mixing unit of FIGS. 1-5 mounted therein.
Figure 7:
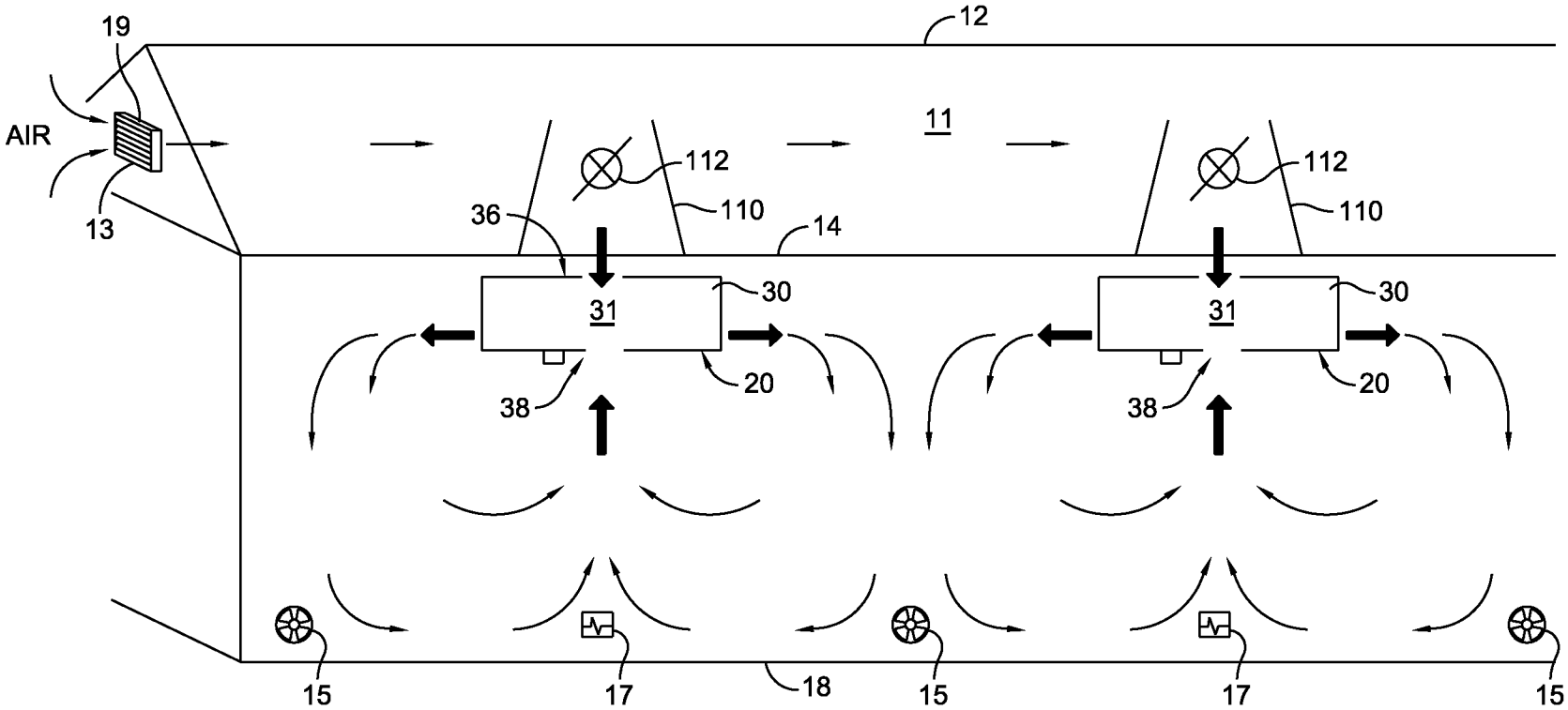
FIG. 7 is a lateral side view thereof.

FIGS. 6 and 7 show one possible embodiment of an air mixing system according to the present disclosure incorporating one or more air mixing units 20. FIG. 6 is a cross-sectional end view through a building structure 10 having an open space, and FIG. 7 is a lateral side view thereof. In some embodiments, the building structure may be an animal rearing facility such as without limitation a poultry house. The building structure 10 includes vertical outer perimeter walls 16, floor 18, roof 12, and ceiling 14 that defining an open occupied space therein, as shown.

An open attic 11 may be defined between ceiling 14 and roof 12. Fresh air may be drawn into the attic 11 through the gable ends and/or from under the eaves of building 10 (see FIGS. 6-7). In some embodiments, one or more fixed or openable/closeable louvers 13 may be provided on the gable ends to allow fresh outside ambient air to be drawn into the attic building 10 for room air exchanges to regulate the air quality within building 10. Such louvers 13 are commercially available. In some embodiments, air drawn into attic 11 may be pre-warmed by attic heaters 19, which may be incorporated with or positioned proximate to louvers 13 (see FIG. 7). In other embodiments, attic heaters 19 may be positioned elsewhere in attic 11 distal to louvers 13. Heaters 19 may be any suitable type of commercially-available heater including electric, steam, or hot water coils. In other embodiments, if heaters 19 are remote from louvers 11, hot air blowers or other self-contained heating units may be used to pre-warm the outside air.

In some embodiments (not shown), building 10 may have a partially or totally open ceiling area lacking a physical ceiling structure in some or a majority of areas beneath the joists and rafters (not shown) supporting the roof 12 (e.g. open joist design). Air mixing units 20 may be used for air circulation and ventilation in these open joist types of structures in addition to building 10 shown in FIGS. 6 and 7 having a ceiling 14 structure which acts as a physical barrier between attic 11 and the occupied heated space or room below.

Air mixing units 20 may be mounted at or proximate ceiling 14 as shown in FIGS. 6 and 7 in some preferred embodiments to take advantage of captured already heated room air which has risen to the higher elevations in building 10. Accordingly, in some embodiments, fans units 20 may be mounted in at least the upper third of the conditions space or room below ceiling 14 and preferably near the ceiling (see, e.g. FIGS. 6 and 7). Mounting plates 66 of frame 60 may therefore be attached to the joists in the ceiling area in some embodiments to support the fans 20. In other less preferred, but suitable embodiments, air mixing units 20 may be mounted and positioned within the lower two-thirds of the conditioned room or space more distal from the ceiling.

With continuing reference to FIGS. 6 and 7, the air mixing system in some embodiments may further include one or more air intake ducts 110 disposed in attic 11 which may or may not include an adjustable damper 112. Damper 112 is operable to regulate the quantity of cooler outside air introduced into and mixed with the heated air in the controlled room environment normally inhabited by the building occupants. Accordingly, the dampers 112 allow for the proper mix of fresh outside air from the attic 11 and re-circulated inside room air to meet the ventilation requirements of the building occupants housed in building 10. Air intake ducts may be routed to a building penetration in the gable, eaves or other area of the building to provide for the introduction of fresh outside air without the possibility of contamination in the attic space by pest waste and associated pathogens. Heaters could be provided within these ducts to pre-heat the outside air prior to its introduction into the inhabited areas of the building. For use during times of high environmental temperatures, cooling devices, such as air conditioners, misters, or high pressure foggers, could be provided in the intake duct, at the entrance to the intake duct (outside the building penetration), in the attic, or within the inhabited area of the building in proximate location to the fan. These arrangements would allow the fan to mix cool outside air, possibly preheated, with warm inside air or warm outside air, possibly pre-cooled, with inside air.

Air intake ducts 110 may terminate at a lowest point that is at or proximate to the ceiling 14, and preferably further terminates at a point that is vertically spaced apart from fan 30 as shown in FIGS. 6 and 7 so that there is no direct physical coupling to fan 30 since the fan body 32 itself rotates thereby not permitting direct attachment of the duct. In the embodiment shown, fan 30 is an open frame type design having an exposed rotating fan body and thereby lacks an enclosed physical housing or casing to which ductwork might be attached. Accordingly, fan unit 20 may preferably be mounted directly onto ceiling 14 with the top of rotating fan 30 and top air inlet 36 being separated from the ceiling and intake duct 110 by the dimensions of the mounting frame 60 itself. In some embodiments, therefore, the top of fan 30 may be spaced by a distance of about 12 inches or less from the ceiling 14. This fan unit mounting position minimizes the amount of room air which might flow into top air inlet 36 thereby maximizing the amount of cooler attic air drawn into top air inlet 36 of fan 30.

In operation, rotation of the fan 30 with radial blades 70 by motor drive 100 draws air axially into the body 32 of the fan through both opposing upper and lower air inlets 36, 38 which are axially aligned with rotational axis RA of the fan in some embodiments. Cooler outside air (pre-warmed or not in attic 11) is drawn into fan 30 through top air inlet 36 and mixed in mixing chamber 31 with and tempered by warmer rising room air drawn in through bottom air inlet 38 before any air is radially/laterally discharged by the fan to the temperature controlled conditioned room space (see airflow directional arrows in FIGS. 6 and 7). The tempered air is propelled and discharged radially and laterally outward from fan 30 for a full 360 degrees in all directions to establish a broad air circulation pattern in the room (see airflow direction arrows). Since the fans 30 are mounted at or near the ceiling in some preferred embodiments, this establishes an air circulation pattern having a downwards flowing curtain of air around the interior perimeter of the building from the ceiling and an upwards flowing columns of air in the interior portions of the building as shown by the air flow arrows in FIGS. 6 and 7. The warm room rises upwards towards the bottom air inlet 38 in the fans. The air circulation loop effectively causes destratification of the building air which promotes uniform temperatures and air quality at various elevations throughout the building.

Beneficially, air mixing system disclosed herein does not require any heating of air within the air mixing unit itself and takes full advantage of existing warmer room temperature air to temper the incoming cooler air. In addition, the lateral dispersion of air from the fan 30 in all directions while avoiding an axial downward discharge directly toward the building occupants advantageously provides a gentle flow of air and ventilation thereby avoiding uncomfortable localized drafts. Preferably, the fans 30 in some embodiment may be characterized by relatively low velocity air discharge over a wide area to minimize drafts.

The foregoing air mixing system provides more uniform air temperatures throughout the building because it immediately mixes cooler outside air upon entry with warmest inside air that has risen to the ceiling area and distributes the tempered air throughout the building. Gentle, but consistent air movement through the building or facility without cold drafts ensures adequate fresh air to building occupants such as animals in some embodiments and promotes drying of manure in addition to dispersion of localized ammonia concentrations (if any) through air destratification.

In some embodiments, referring to FIGS. 6 and 7, commercially-available electric exhaust fans 15 may optionally be provided to eliminate dead air zones within building 10 while providing for exhaust and exchange of inside air. Exhaust fans 15 may be any type of commercially-available fans suitable for heating open building spaces. In addition, heaters 17 may optionally be provided to supply supplemental heating to the interior conditioned space or room as required. Heaters 17 may be any type of commercially-available heaters suitable for heating open building spaces including radiant type heaters, forced hot air convective type heaters, etc. The heaters or exhaust fans may be mounted at any suitable location(s) within building 10 as appropriate depending on the type of building space and the room occupants.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that embodiments according to the present disclosure may be include other forms, structures, arrangements, proportions, sizes, and with other elements, materials, and components, without departing from the spirit or essential characteristics thereof. One skilled in the art will further appreciate that the embodiments may be used with many modifications of structure, arrangement, proportions, sizes, materials, and components and otherwise, used in the practice of the invention, which are particularly adapted to specific environments and operative requirements without departing from the principles of the present invention. In addition, numerous variations in the exemplary methods and processes described herein may be made without departing from the spirit of the present disclosure. The presently disclosed embodiments are therefore to be considered in all respects as illustrative and not restrictive, the scope of the invention being defined by the appended claims and equivalents thereof, and not limited to the foregoing description or embodiments.

What is claimed is:

1. An air mixing unit for a building, the unit comprising:

a frame configured for being mounted to a building superstructure;

a centrifugal fan supported by the frame for rotational movement, the fan including a rotatable body comprised of vertically spaced apart upper and lower plates each having at least one air inlet opening formed therein, a drive shaft defining a vertical rotational axis, the drive shaft received through and mechanically coupled to a tubular hub, a plurality of blades, a top air inlet, and a bottom air inlet, wherein the plurality of blades extend radially outward from the vertical rotational axis, each of the blades having a main body and upper and lower flanges disposed perpendicular to the main body to facilitate mounting to the upper and lower plates, each of the blades having an inner mounting end attached to two circular flanges disposed on each of the opposite ends of the tubular hub, the inner mounting end having an edge extending between the upper and lower flanges of the blade, wherein the edge curves away from the tubular hub between the two circular flanges disposed on each of the opposite ends of the tubular hub;

an air mixing chamber provided proximate to and around the tubular hub, wherein the air mixing chamber is defined by the edge of the inner mounting end where the air from the top and bottom air inlets are mixed; and a motor drive operable to rotate the fan;

wherein rotation of the fan draws inlet air through both the top and bottom air inlets, mixes the inlet air together in the air mixing chamber, and radially discharges the mixed air laterally outwards from the fan.

2. The air mixing unit of claim 1, wherein the top and bottom air inlets are axially aligned.

3. The air mixing unit of claim 1, wherein the top air inlet is defined by at least one opening in a circular shaped upper plate and the bottom air inlet is defined by at least one opening in a circular shaped lower plate spaced vertically apart from the upper plate.

4. The air mixing unit of claim 3, wherein the radially-oriented blades are mounted between the upper and lower plates.

5. The air mixing unit of claim 1, wherein at least the top or bottom air inlet includes a plurality of circumferentially spaced apart arcuate openings formed in the fan body.

6. The air mixing unit of claim 5, wherein the blades are mounted to the fan body between the arcuate openings.

7. The air mixing unit of claim 1, wherein the fan has a circular configuration and open lateral annular sides defining an air discharge outlet extending 360 degrees around the fan.

8. The air mixing unit of claim 1, wherein the frame includes a plurality of horizontal and vertical tubular members joined together to form an open structure, at least a portion of the fan body protruding laterally outwards beyond the frame.

9. The air mixing unit of claim 1, wherein ends of the central drive shaft are supported by an opposing pair of bearing flanges mounted to the frame for rotational motion.

10. The air mixing unit of claim 1, wherein the motor drive is a belt-driven system comprising a motor, a pair of spaced apart sheaves, and a belt driven around the sheaves by the motor.

11. An air mixing system for a building, the system comprising:

a building having a floor, a ceiling, and vertical walls defining an open space;

an air mixing unit disposed in the open space of the building, the air mixing unit including a rotatable centrifugal fan having a rotatable fan body comprised of vertically spaced apart upper and lower plates each having at least one air inlet opening formed therein, a vertically-oriented fan drive shaft defining a vertical rotational axis of the fan, the drive shaft received through and mechanically coupled to a tubular hub, a plurality of blades, a top air inlet, a bottom air inlet, and a lateral discharge outlet, wherein the plurality of blades extend radially outward from the vertical rotational axis, each of the blades having a main body and upper and lower flanges disposed perpendicular to the main body to facilitate mounting to the upper and lower plates, each of the blades having an inner mounting end attached to two circular flanges disposed on each of the opposite ends of the tubular hub, the inner mounting end having an edge extending between the upper and lower flanges of the blade, wherein the edge curves away from the tubular hub between the two circular flanges disposed on each of the opposite ends of the tubular hub;

an air mixing chamber provided proximate to and around the tubular hub, wherein the air mixing chamber is defined by the edge of the inner mounting end where the air from the top and bottom air inlets are mixed;

a motor drive operable to rotate to the fan;

wherein rotation of the fan draws an air inlet stream into the fan from opposing axial directions through the bottom and top air inlets, mixes the air inlet streams for tempering the air, and radially discharges the mixed air laterally outwards from the fan to the open space.

12. The air mixing system of claim 11, wherein the discharge outlet extends for 360 degrees around the rotational axis of the fan.

13. The air mixing system of claim 11, wherein the fan is mounted proximate to the ceiling of the building.

14. The air mixing system of claim 11, wherein the air mixing unit includes an open frame that supports the fan thereon for rotational motion.

15. The air mixing system of claim 11, wherein the top and bottom air inlets are axially aligned with the vertical rotational axis of the fan.

16. The air mixing system of claim 11, wherein the top air inlet is defined by at least one opening in a circular shaped upper plate and the bottom air inlet is defined by at least one opening in a circular shaped lower plate spaced vertically apart from the upper plate.

17. The air mixing system of claim 16, wherein the blades are mounted between the upper and lower plates.

18. A method for mixing and destratifying air within an open space of a building, the method comprising:

mounting a centrifugal fan in the open space, the fan including a rotatable fan body comprised of vertically spaced apart upper and lower plates each having at least one air inlet opening formed therein, and a plurality of blades mounted between the plates, each of the blades having a main body and upper and lower flanges disposed perpendicular to the main body to facilitate mounting to the upper and lower plates, the fan further including a vertically oriented central drive shaft operable to rotate the fan and defining a vertical rotational axis of the fan, the drive shaft received through and mechanically coupled to a tubular hub, wherein the plurality of blades extend radially outward from the vertical rotational axis, each of the blades having an inner mounting end attached to two circular flanges disposed on each of the opposite ends of the tubular hub, the inner mounting end having an edge extending between the upper and lower flanges of the blade, wherein the edge curves away from the tubular hub between the two circular flanges disposed on each of the opposite ends of the tubular hub;

an air mixing chamber provided proximate to and around the tubular hub, wherein the air mixing chamber is defined by the edge of the inner mounting end where the air from the top and bottom air inlets are mixed;

rotating the drive shaft with a motor drive thereby drawing inlet air streams into the fan from opposing axial directions through the air inlet openings in the upper and lower plates and the inlet air streams are mixed in the air mixing chamber and radially discharged laterally outwards into the open space.

19. The method of claim 18, wherein the air inlet openings are concentrically aligned with the rotational axis of the fan.

* * * * *